US008434968B2

(12) United States Patent
Birkeland

(10) Patent No.: US 8,434,968 B2
(45) Date of Patent: May 7, 2013

(54) SHIP QUAY WITH AN INTEGRATED STORAGE SILO

(75) Inventor: Per Ivar Birkeland, Sandnes (NO)

(73) Assignee: Birken & Co. AS

( * ) Notice: Subject to any disclaimer, the term of this patent is extended or adjusted under 35 U.S.C. 154(b) by 0 days.

(21) Appl. No.: 13/502,372

(22) PCT Filed: Oct. 21, 2010

(86) PCT No.: PCT/NO2010/000373

§ 371 (c)(1),
(2), (4) Date: Apr. 17, 2012

(87) PCT Pub. No.: WO2011/049464

PCT Pub. Date: Apr. 28, 2011

(65) Prior Publication Data

US 2012/0205217 A1 Aug. 16, 2012

(30) Foreign Application Priority Data

Oct. 23, 2009 (NO) ..... 20093203

(51) Int. Cl.
*E02B 3/06* (2006.01)
*B65D 88/78* (2006.01)

(52) U.S. Cl.
USPC ..... 405/210; 405/218; 220/501

(58) Field of Classification Search ..... 405/51, 405/195.1, 210, 218, 284, 286; 220/484, 220/501
See application file for complete search history.

(56) References Cited

U.S. PATENT DOCUMENTS

| | | | | |
|---|---|---|---|---|
| 4,448,571 | A * | 5/1984 | Eckels | 405/284 |
| 6,082,931 | A * | 7/2000 | Hopper | 405/218 |
| 6,234,714 | B1 | 5/2001 | Chattey | |

FOREIGN PATENT DOCUMENTS

| | | |
|---|---|---|
| FR | 2332372 | 6/1977 |
| GB | 480911 | 3/1938 |
| SE | 400520 | 4/1978 |
| WO | WO 99/54235 | 10/1999 |

OTHER PUBLICATIONS

ISR of Jan. 2, 2011, submitted inter alia as statement of relevance of foreign language references.

* cited by examiner

*Primary Examiner* — Tara M. Pinnock
(74) *Attorney, Agent, or Firm* — Christian D. Abel

(57) ABSTRACT

A quay structure (1) comprising a quay top (12) is described, wherein one or more storage receptacles (2), which are structured in a manner allowing them to receive an anchor chain (4), are disposed underneath an available area (16) provided on, or in association with, the quay top (12), the storage receptacle (2) being provided with a cover (23) forming, when in a closed state, a portion of said available area (16). A method of using the quay structure (1) for storage of an anchor chain in association with a maintenance operation on the anchor chain is also described.

9 Claims, 1 Drawing Sheet

SHIP QUAY WITH AN INTEGRATED STORAGE SILO

Figure 1:
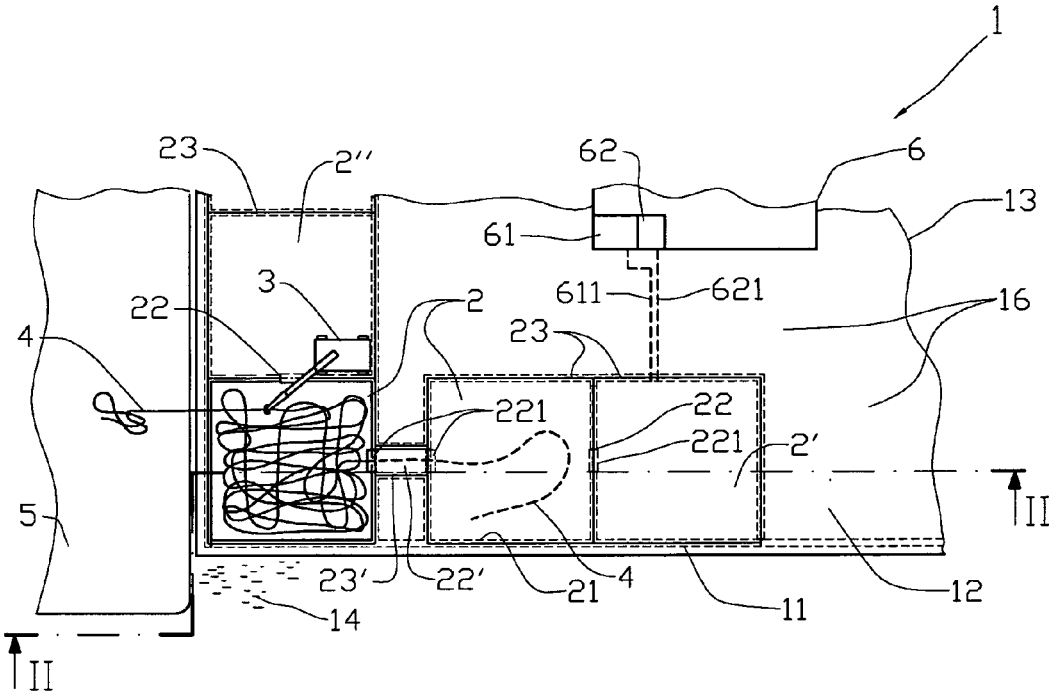

A quay structure comprising a quay top is described, more particularly by virtue of one or more storage receptacles, which are structured in a manner allowing them to receive an anchor chain, being disposed underneath the quay top, the storage receptacle being provided with a cover forming, when in a closed state, a portion of an available area disposed on, or in association with, the quay top.

During maintenance of an anchor chain, for example inspection and certification thereof, large land areas are required today for intermediate storage of the chain, possibly also for mooring space for vessels used for transport or retrieval of the chain from temporary disposal sites on the seabed, and/or for placement of the chain in temporary disposal sites on the seabed nearby the facility being used for maintenance of the chain. Temporary storage on the seabed, or on open land areas, may represent an environmental pollution risk. The maintenance is time-consuming and occupies expensive quay space for the vessels and storage areas involved, particularly in context of the chain being pulled over long distances on the land surface between the storage areas and the inspection/maintenance facility. In order to pull large chain lengths over long distances, use of friction-reducing means, for example support rollers and lubricants, are required. In order to reduce the disadvantages resulting from the chain occupying much space and preventing traffic when being extended, it is known to advance the chain within covered culverts, etc. A long lay time for vessels involved also drives the costs for the maintenance operations. It will also be beneficial In terms of safety, it will also be favourable to reduce the number of transfers of the chain.

The object of the invention is to remedy or reduce at least one of the disadvantages of the prior art, or at least to provide a useful alternative to the prior art.

The object is achieved by virtue of features disclosed in the following description and in the subsequent claims.

The invention provides one or more storage receptacles disposed in a sunken state within a quay structure. The receptacle may be of any shape, insofar as it is to be structured in a manner allowing it to receive a chain which, due to the nature thereof, will be able to substantially fill any volume shape provided the size of the receptacle is in a reasonable proportion to the dimension, and particularly the length, of the chain links, which any person skilled in the art will be able to assess successfully.

Advantageously, several receptacles may be disposed side by side and, particularly, be disposed in a row so as to form a part of the front of the quay structure with respect to the sea. Several receptacles may be disposed in several rows arranged within one or more batteries. Expediently, the receptacle is provided with a cover closing the top of the receptacle and forming a part of the driving surface of the quay structure. The entire cover, or parts thereof, is/are structured in a manner allowing it/them to be opened when the chain is to be lowered into the receptacle, or to be retrieved therefrom.

Advantageously, when several receptacles are disposed in proximity of each other, they are provided with passages connecting adjoining receptacles in such a way that a chain length, which cannot be accommodated by only one receptacle, may be conveyed onwards to the next receptacle via, for example, a closable channel disposed directly below the surface of the quay structure, and/or in the upper portions of adjoining receptacle walls. Advantageously, the passage is closed by a drivable cover closing the top of the receptacle and forming a part of the driving surface of the quay structure.

Advantageously, a guiding apparatus is associated with the receptacle. The guiding apparatus is structured in a manner allowing it to guide the chain towards any area of the base of the receptacle. The guiding apparatus may be stationary and fixedly installed in the receptacle, or it may be movable between several of the receptacles.

Advantageously, the passages between the receptacles are provided with guiding devices structured to allow the chain to be pulled from a receptacle and through adjoining receptacles and onto an associated facility for maintenance of the chain. Thereby, the available area of the quay structure and the adjoining areas may be kept free of chain to a great extent when the chain is to be pulled from the storage receptacle and onto the maintenance facility. The traffic on the area may thus take place substantially unobstructed by the chain maintenance.

Advantageously, the storage receptacle is provided with a fluid-communicating connection to the adjoining water mass, thereby allowing water to be supplied to the storage receptacle to initiate, for example, a cleaning process by means of soaking, possibly in combination with addition of chemicals, whilst the anchor chain still is stored prior to the maintenance.

In a first aspect, the invention more specifically relates to a quay structure comprising a quay top, characterized in that one or more storage receptacles, which are structured in a manner allowing them to receive an anchor chain, are disposed underneath an available area provided on, or in association with, the quay top, the storage receptacle being provided with a cover forming, when in a closed state, a portion of said available area.

Adjoining storage receptacles may be mutually connected by a passage structured in a manner allowing it to accommodate a portion of the anchor chain. Thereby, the anchor chain may be accommodated by several storage receptacles without a portion of the anchor chain occupying space on the quay top or on the transport area.

The passage may be provided with means structured to facilitate advancement of the anchor chain through the passage. Thereby, the anchor chain may be pulled through the passage from one storage receptacle and onto another.

A side wall of the storage receptacle may form a portion of a quay front delimiting a quay body with respect to a mass of water. A structure having several functions is thus provided.

The storage receptacle may be fluid-tight against the adjoining quay body and other loose mass or underground and also against the water mass. Thereby, the storage receptacle may accommodate a fluid in addition to the anchor chain, for example for use in a part of the maintenance process.

The storage receptacle may be provided with at least one closable opening structured in a manner allowing it to be in fluid-communicating connection with the water mass. Thereby, sea water may be supplied in a simple manner for use in a part of the maintenance process.

The storage receptacle may be provided with at least one closable opening structured in a manner allowing it to be in fluid-communicating connection with a water reservoir. The advantage thereof is that the composition of the supplied water may be adapted to a specific maintenance requirement.

The storage receptacle may be provided with at least one closable opening structured in a manner allowing it to be in fluid-communicating connection with a chemical plant. Thereby, the anchor chain may undergo an initial and/or final treatment with cleaning agents, preservatives or other suitable chemicals in an enclosed space.

In a second aspect, the invention more specifically relates to a method for storage of an anchor chain in context of a maintenance operation on the anchor chain, the maintenance operation being carried out at a maintenance facility associated with a quay structure arranged for reception of the anchor chain, characterized in that the method comprises the steps of:

a) conducting the anchor chain into a first storage receptacle disposed underneath an available area provided on, or in association with, a quay top;

b) conducting, in a continuous or stepped process, the anchor chain from the first storage receptacle and onto the maintenance facility for accomplishment of the maintenance operation; and c) conducting, in a successive manner, the anchor chain into a second storage receptacle disposed underneath said available area.

Within the first storage receptacle, an initial cleaning process on the anchor chain may be carried out. Within the second storage receptacle, a preservation process on the anchor chain may be carried out. This may render the maintenance operation at the maintenance facility more efficient. A large degree of control over the cleaning agents, preservatives and substances released from the anchor chain is also achieved.

Figure 2:
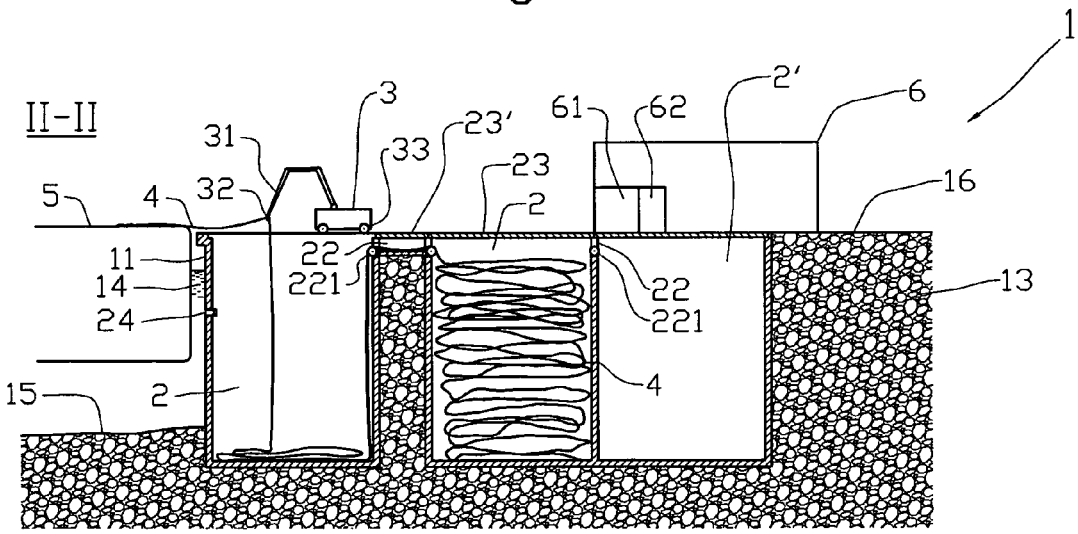

In the following, an example of a preferred embodiment is described and depicted in the accompanying drawings, wherein:

FIG. 1 shows, in plan view, a principle drawing of parts of a quay structure provided with storage receptacles according to the invention; and FIG. 2 shows a vertical section II-II through the quay structure.

In the figures, reference numeral 1 denotes a quay structure with a quay front 11 delimiting a quay body 13, which consists of loose masses, the original underground, etc., with respect to a water mass 14, insofar as it extends, in a manner known per se, from a seabed 15 and upwards to a quay top 12 forming a part of an available area 16.

The quay structure 1 is arranged in a manner allowing it to receive one or more vessels 5 structured in a manner allowing them to handle an anchor chain 4.

A maintenance facility 6 for anchor chains 4 is associated with the quay structure 1.

Several storage receptacles 2, 2', 2" with open tops are disposed in a sunken state within the quay structure 1, one or more receptacle walls 21 forming one or more portions of the quay front 11.

The storage receptacles 2, 2', 2" are each provided with an openable and closable cover 23 forming, when in a closed position, a part of the quay top 12 or an available area 16 associated with the quay top 12 and, therefore, it is dimensioned so as to be able to withstand the load exerted by goods and vehicles located on the quay structure 1.

A passage 22, 22' is disposed between adjoining storage receptacles 2, 2', 2", the passage of which is structured in a manner allowing it to accommodate a portion of the anchor chain 4 when having a length of such an extent that it cannot be accommodated in just one storage receptacle 2, 2', 2". The passage is disposed at the top of the storage receptacle 2, 2', 22" and as a recess 22 in the receptacle wall 21, possibly as a channel 22' having an open top capable of being closed with an openable and closable cover 23' forming, when in a closed position, a part of the quay top 12 or an available area 16 associated with the quay top 12 and, therefore, it is dimensioned so as to be able to withstand the load exerted by goods and vehicles located on the quay structure 1. The passage 22, 22' is provided with one or more means, which is shown herein as a guide roller 221, for facilitating the advancement of the anchor chain 4 through the passage 22, 22' when pulling the anchor chain 4 out of the storage receptacle 2, 2', 2".

The storage receptacle 2, 2', 2" is provided with a closable fluid line 24, which is shown herein as a connection between the water mass 14 and the storage receptacle 2, 2', 2", but the fluid line may just as well be connected to a water reservoir 61, indicated in FIG. 1 by the reference numeral 611, the embodiment of which is advantageous should the storage receptacle 2, 2', 2" also be connected, in a fluid-communicating manner, to a chemical plant 62, which in FIG. 1 is shown as a chemical line between the chemical plant 62 and the storage receptacle 2'.

A guiding apparatus 3 is associated with the storage receptacles 2, 2', 2", the apparatus of which is shown herein as a portable guiding apparatus 3 provided with transport wheels 33, a movable arm 31 and a drive roller 32 structured for advancement of the anchor chain 4. Alternatively, the guiding apparatus 3 may be provided on the vessel 5.

The anchor chain 4, which is to undergo a maintenance operation, is carried to the quay structure 1 by means of the vessel 5. The anchor chain 4 is guided down into one of the storage receptacles 2, 2', 2", which has been opened by virtue of the cover 23 having been moved into a fully or partially open position. The anchor chain 4 is guided down into the storage receptacle 2, 2', 2" by means of the guiding apparatus 3, possibly assisted by some other piece of equipment (not shown) suitable for the purpose.

If the anchor chain 4 is not accommodated by one storage receptacle 2, 2', 2", several storage receptacles 2, 2', 2" are used, insofar as a portion of the anchor chain 4 is placed in the passage 22 and the remainder of the anchor chain 4 is lowered into the next storage receptacle(s) 2, 2', 2" without occupying any space on the quay top 12 or on the available area 16.

When the anchor chain 4 has been placed in the storage receptacle/receptacles 2, 2', 2", the cover/covers 23, 23' is/are put into place.

As an initial step in the maintenance process, the anchor chain 4 may be supplied with water from the adjoining water mass 14 or the water reservoir 61, possibly with chemicals from the chemical plant 62 added through lines 611, 621.

When the anchor chain is to be conducted through the maintenance plant 6, the storage receptacle 2, 2', 2" is opened and the accessible end of the anchor chain 4 is conducted onto the maintenance plant 6. The anchor chain 4 is pulled continuously or in steps out of a first storage receptacle 2' and through the maintenance plant 6 and onto a second storage receptacle 2" within which the already checked anchor chain 4 is stored whilst awaiting transport back to a point of use. In the second storage receptacle 2", the anchor chain 4 may be supplied with a preservative from the chemical plant 62, or it may undergo some other final treatment.

When required, both the first and the second storage receptacles 2', 2" may be comprised of several storage receptacles mutually connected by means of said passage 22 or channel 22' should the anchor chain 4 be of such an extent that it is not accommodated by one storage receptacle 2', 2".

The passages 22/channels 22' and the associated guide rollers 221 may be used for advancement of the anchor chain 4 below the quay top 12 and the available area 16, insofar as the anchor chain may be pulled from its storage receptacle 2, 2', 2" through the top of the adjoining storage receptacle(s) 2, 2', 2", and through passages 22 and possible channels 22' below closed covers 23, 23'.

The invention claimed is:

1. A quay structure comprising a quay top having a driving surface for vehicular traffic, wherein a plurality of adjoining or adjacent storage receptacles arranged to receive an anchor chain are disposed underneath the driving surface, at least one of the storage receptacles being provided with an openable and closable cover forming, when in a closed state, a portion of said driving surface, wherein adjoining or adjacent storage receptacles are mutually connected by a passage disposed in an upper portion of the storage receptacle, the passage being structured in a manner allowing it to accommodate a portion of an anchor chain, the passage further being provided with a chain-advancing mechanism for advancing the chain between receptacles.

2. The quay structure in accordance with claim 1, wherein a side wall of at least one of the storage receptacles forms a portion of a quay front delimiting a quay body with respect to a water mass.

3. The quay structure in accordance with claim 1, wherein at least one of the storage receptacles comprises a chain-washing arrangement.

4. The quay structure in accordance with claim 3 , wherein the chain-washing arrangement comprises a closable fluid line in fluid-communicating connection with a water source.

5. The quay structure in accordance with claim 4, wherein the water source is the water mass.

6. The quay structure in accordance with claim 3, wherein the chain-washing arrangement comprises a fluid-communicating connection with a chemical plant.

7. A method for storing and maintaining an anchor chain of the anchor chain being carried out at a maintenance facility associated with a quay structure arranged for reception of anchor chains, wherein the method comprises the steps of:

a) providing and transporting an anchor chain to the quay structure, b) conducting the anchor chain into a first storage receptacle disposed underneath an available area provided on, or in association with, a quay top;

c) conducting, in a continuous or stepped process, the anchor chain from the first storage receptacle and onto the maintenance facility for accomplishment of a maintenance operation; and d) conducting, in a successive manner, the anchor chain into a second storage receptacle disposed underneath said available area.

8. The method in accordance with claim 7, further comprising carrying out, within the first storage receptacle, an initial cleaning process on the anchor chain.

9. The method in accordance with claim 7, further comprising carrying out, within the second storage receptacle, a preservation process on the anchor chain.

* * * * *